United States Patent [19]

Naito et al.

[11] 4,240,788

[45] Dec. 23, 1980

[54] INTERMITTENT TOP FIRING TUNNEL KILN EQUIPPED WITH A BURNER HAVING A CERAMIC AIR NOZZLE

[75] Inventors: Kiyoshi Naito, Urawa; Akio Syukuya, Kawagoe, both of Japan

[73] Assignee: Shinagawa Refractories Co., Ltd., Tokyo, Japan

[21] Appl. No.: 48,452

[22] Filed: Jun. 14, 1979

[30] Foreign Application Priority Data

Jun. 14, 1978 [JP] Japan ..... 53-70794

[51] Int. Cl.[3] ..... F27B 9/02; F24H 1/00

[52] U.S. Cl. ..... 432/136; 431/160; 431/188; 432/222; 432/241

[58] Field of Search ..... 432/136, 222, 241; 239/DIG. 19, 424; 431/160, 181, 187, 188

[56] References Cited

U.S. PATENT DOCUMENTS

| | | | |
|---|---|---|---|
| 491,995 | 2/1893 | Falasconi | 432/241 |
| 3,711,243 | 1/1973 | Zink et al. | 431/181 |
| 4,060,379 | 11/1977 | LaHaye et al. | 432/222 |
| 4,060,380 | 11/1977 | Bolt | 432/222 |

*Primary Examiner*—John J. Camby

*Attorney, Agent, or Firm*—Larson, Taylor and Hinds

[57] ABSTRACT

An intermittent top firing tunnel kiln equipped with a burner having a ceramic air nozzle, in which an air nozzle assembly is mounted to a wind box adjacent to the burner tile through a burner support tile, said assembly being constructed by a metallic air supply pipe supported by a metal fixture at the ceiling portion of the kiln and being connected at the tip of said pipe to the ceramic air nozzle, and in which an oil nozzle is disengagably provided at the center in said air nozzle assembly, whereby the secondary air for combustion is supplied to said wind box through the walls of the kiln.

1 Claim, 3 Drawing Figures

Figure 1:
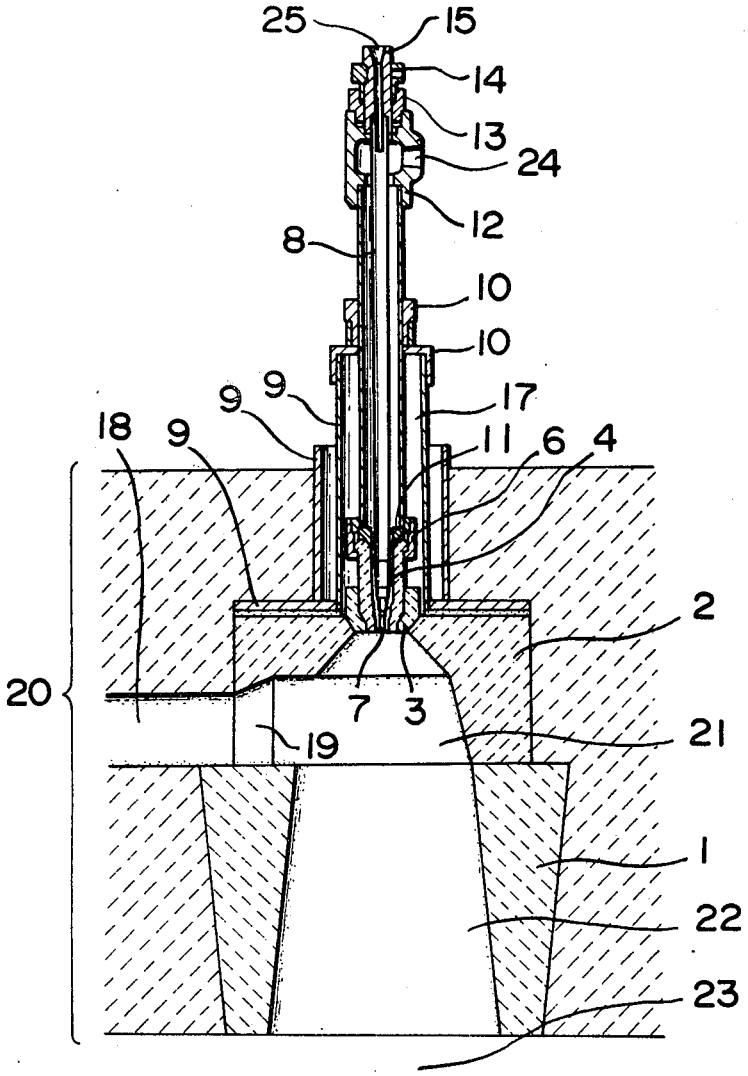

INTERMITTENT TOP FIRING TUNNEL KILN EQUIPPED WITH A BURNER HAVING A CERAMIC AIR NOZZLE

This invention relates to an improvement of an intermittent top firing tunnel kiln of such construction that fuel is directly burned in the kiln with the system in which as method of placing articles to be baked onto the baking car, spaces as combustion chamber are provided between the articles to be baked, and more particularly, to an intermittent top firing tunnel kiln equipped with a liquid fuel burner used mainly for ceramic industry, in which the air nozzle at the burner tip portion constituting principal part of the burner, and the burner tile, wind box and burner support tile constituting attachments of the burner are made of ceramic materials in integrity with the construction of the kiln ceiling, the secondary air temperature for combustion is in the range from about 350° C. to about 750° C., and the burner is endurable for a long period of time for use under high temperature conditions of the range 1350° C.–1650° C. as heating temperature within the kiln.

High temperature tunnel kiln generally used at present is influenced for its performance by the performance of burner. That is, there occur troubles that the tip portion of the burner nozzle is heated to high temperature when in use thereby wearing or deforming said part due to oxidation thereof and that the oil nozzle is blocked up by carbon.

To continuously use the tunnel kiln for longer period of time, therefore, measures for protecting the burner tip is required. As the measures therefor there are mentioned (1) use of refractory steel, (2) water cooling system and (3) air cooling system. These methods are industrially used in general but they have the following demerits:

(1) Use of Refractory Steel

Even if refractory steel is used as burner tip part, said part may be greatly worn because of oxidation thereof to be shortened in its life, in case the heating temperature within the kiln is higher than 1300° C. and the secondary air temperature for combustion is higher than 350° C. Further, in such a case the air nozzle and the oil nozzle are brought into a red-hot state, carbon in fuel accumulates in said parts whereby the nozzles are blocked to lower the burner function and the burner becomes non-usable. Since it is impossible to use the burner in succession for a long period of time, much labor is required for daily maintenance and supervision of the burner.

(2) Water Cooling System

This system is of the most general type for countermeasure against high temperature higher than 1500° C. in heating temperature within the kiln and higher than 450° C. in air temperature for combustion, but it is absolutely necessary to prevent leakage of cooling water which may be caused by wear or the like of water cooling pipe. Moreover, cooling water must be continuously supplied even at the time of interruption of electric current so that a vast amount of expenses are incurred even for cooling water supply equipment for emergency use, and daily supervision of the equipment is also necessary. Further, critical fault of the water cooling system is that there is a great heat loss due to water cooling. According to an example of baking equipment the inventors have experienced, approximately 250 Kl of fuel is lost a year in case 20 units of water cooling burner whose capacity is 100,000–300,000 Kcal/H are installed.

The water cooling system may hastily settle the problem such as nozzle blockade caused by oxidation wear of tip parts and carbon accumulation of fuel, but it is necessary to repair or replace the water cooling pipe thereby requiring a lot of labor for maintenance and supervision of the pipe.

If water has leaked from the water cooling pipe an explosion will be caused in the kiln, and therefore the water cooling system is accompanied by danger.

(3) Air Cooling System

In this system, the air at room temperature is used as combustion air. It demands less equipment cost and is easily adoptable but it is not fit for the needs of the energy saving age. Particularly in the case of the kiln for ceramics it is capable of easily recovering a great amount of high temperature air from the cooling zone, and in consideration of its effective use the air cooling system cannot be said to be good measures.

As described above, at present the burners for tunnel kiln, which are provided with construction or function with which they can stand the use at high temperature for a long period of time, have some merits and demerits and are mostly against energy saving policy. In addition there are many disadvantages such as requiring much expenditure and labor for maintenance and supervision of said burners.

As a counterplan against these disadvantages it is being tried to utilize burners where conventionally air nozzle only is simply made of ceramic.

The reason why the ceramic air nozzle is not as yet in practical use resides in that ceramic has a common property of matter that it is weak against thermal shock, and that when the burner is dismantled for the cleaning of its tip and the replacing of oil nozzle, said ceramic portion is likely to crack and break owing to the quick cooling and results in short life. Moreover, there are constructional faults even in the feeding method of high temperature air for combustion thereby causing abnormal heating at the tip portion of the burner.

The object of the present invention is to settle the various problems of tunnel kiln and burner thereof for use at high temperature, and to provide a tunnel kiln in which it is possible to bear high temperature in continuous use for a long period of time, needs for energy saving are satisfied, and maintenance and supervision are easier. According to the invention an oil nozzle is detachable in a state where said ceramic air nozzle is mounted to the burner tile of the kiln body, and the secondary air for combustion is fed from the wind box at the tip portion of said air nozzle thereby avoiding the thermal shock damage which is the maximum demerit of the ceramic air nozzle. In addition, even the burner assembly itself is detachable if necessary.

The subject matter of the invention resides in an intermittent top firing tunnel kiln equipped with a burner having a ceramic air nozzle, in which an air nozzle assembly is mounted to a wind box adjacent to the burner tile through a burner support tile, said assembly being constructed by a metallic air supply pipe supported by a metal fixture at the ceiling portion of the kiln and being connected at the tip of said pipe to the ceramic air nozzle, and in which an oil nozzle is disengagably provided at the center in said air nozzle assembly, whereby the secondary air for combustion is supplied to said wind box through the walls of the kiln.

Figure 2:
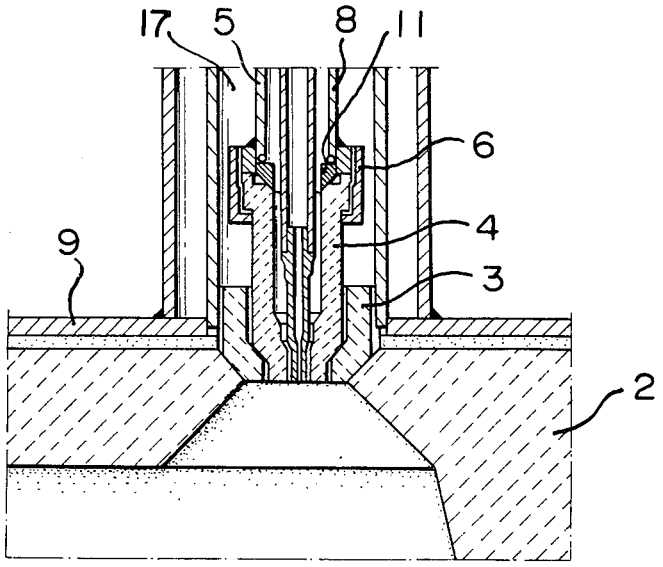
Figure 3:
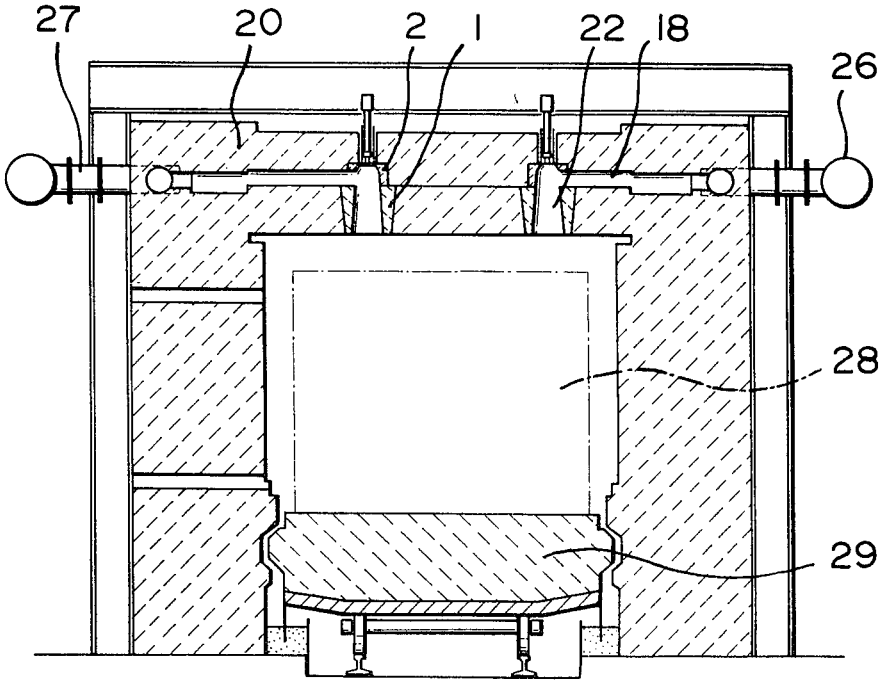

In order that the construction, function and effect of the invention may be more clearly understood one embodiment of the tunnel kiln and burner thereof relating to the invention will be described, by way of example, with reference to the accompanying drawings, in which, FIG. 1 is a sectional view showing a state in which the burner having a ceramic air nozzle has been mounted to the ceiling (a wall) of the tunnel kiln of the invention;

FIG. 2 is a sectional view showing the essential parts of the burner in detail; and FIG. 3 is a sectional view of the firing zone of the tunnel kiln.

In the drawings, the reference 1 designates a burner tile, the reference 2 a wind box and the numeral 9 a metal fixture for burner respectively, and they are constructed in integrity with kiln walls 20. The wind box 2 is provided with an air feeding passage 19 communicating with a secondary air supply passage 18 for combustion provided within the kiln walls and with an air duct 26, from which passage 19 a high temperature combustion air (about 350°-750° C.) is supplied into an air mixing chamber 21.

The numeral 22 is a conical tubular opening piercing into the center of said burner tile 1.

The reference 3 indicates a burner support tile and the reference 4 an air nozzle. They are detachable. They can be prevented from blockade due to carbon, and therefore they need not be dismantled frequently such as for cleaning and can be operated for a long period of time, being fixed to the kiln walls.

Said burner tile 1, wind box 2, burner support tile 3 and air nozzle 4 are made of ceramic material, and they are the basic component parts of the high temperature burner for the tunnel kiln. The reference 7 shows an oil nozzle and the reference 9 is a metal fixture for burner, both being made of refractory steel but the other metal elements being made of normal steel.

The role of said burner support tile 3 is to relieve the thermal influence given upon the air nozzle.

The air nozzle 4 is connected to an air supply pipe 5 with a coupling fitting 6 by way of surface contact, and said air supply pipe 5 is connected to a burner body 12.

Then the air supply pipe 5 is fixed to the metal fixture 9 for burner by a burner fixing fitting 10, while the air nozzle 4 is retained at the central position of the air mixing chamber 21 and said opening 22 within burner tile 1.

The oil nozzle 7 is connected to an oil supply pipe 8 and an oil supply fitting 15 and set within the air nozzle assembly constituted by the air supply pipe 5 and the air nozzle 4 which are a primary air system for atomizing oil.

The air nozzle 4 and the oil nozzle 7 must be set in a concentric circle shape, so that a sleeve 11 is provided at the coupling portion of said air nozzle 4 and said air supply pipe 5. Said sleeve 11 is of the construction in which the stream of the primary air for atomization is not disturbed.

The oil supply fitting 15 is assembled into the burner body 12 by metal fixtures 13, 14. In case of cleaning or replacing the oil system portions with the ceramic air nozzle as it is mounted to the kiln body, it is possible to take off the series of oil system portions such as oil nozzle 7, oil supply pipe 8 and oil supply fitting 15 by dismantling only the metal fixture 14.

The reference 23 shows a heating chamber, the reference 24 an atomizing primary air supply inlet, and the numeral 25 an oil supply inlet respectively. The numeral 26 is an air duct for supplying combustion air to each burner at the firing zone, the numeral 27 an air control damper for controlling the quantity of the combustion air, the reference 28 articles to be baked, and the reference 29 a kiln car respectively.

The numeral 17 is a burner chamber sealed by the metal fixture 9 for burner and the burner fixing fitting 10. In case said heating chamber 23 is under high pressure, however, an opening is provided at a portion of the air supply pipe 5 and part of the atomizing primary air is fed into said burner chamber to prevent the high temperature gas from entering said burner chamber whereby over heating is prevented.

Reference is then made to the function of the burner. Firstly fuel oil is fed under pressure by pump (not shown) and then ejected into the air mixing chamber 21 through the central hole of said oil nozzle 7 via the oil supply pipe 8 from the oil supply inlet 25. Normally the oil supplying pressure in this case is lower than 0.5 $Kg/cm^2$.

Secondly the primary air for atomization is supplied from the atomizing primary air supply inlet 24, under a pressure of 0.3-1.2 $Kg/cm^2$, and then it is ejected into the air mixing chamber 21 from the circular clearance between the air nozzle 4 and the oil nozzle 7 through said air supply pipe 5.

The fuel oil ejected from the oil nozzle 7 will be atomized within said air mixing chamber 21 and said opening 22 by means of the atomizing primary air ejected from the outer circumference, and then it will be mixed for burning within said chamber 21 and opening 22 with the secondary high temperature air for combustion which is fed from an air feeding passage 9 under pressure.

If the temperature of said heating chamber 23 is 1650° C. the temperature of the opening 22 in said burner tile 1 becomes about 1550° C. and that within said air mixing chamber 21 about 1400° C.

With regard to the requisite conditions for high temperature burner for tunnel kiln, it will suffice if it is able to prevent the nozzle blockade caused by the carbon trouble and the wear of nozzle parts.

Air nozzle must be excellent in thermal resistance, and particularly in strength in high temperature and antispalling properties. Further, air nozzle must be of good precision in its finished dimension because the tip shape of the air nozzle influences the formation of burning flame. As the ceramic materials which satisfy these conditions there can be mentioned silicon nitride and zirconia.

According to the burner for tunnel kiln of the invention, all the high temperature portions except the oil nozzle 7 are made of ceramic materials as described above, it has been settled the problem in which the metallic portions and the ceramic portions may be damaged or worn owing to thermal expansion difference therebetween, and the merits thereof are used efficiently to their satisfaction.

It is needless to describe that ceramic materials can bear high temperature, but another feature therefor is that thermal conductivity is low compared with metallic materials. The thermal conductivity of said air nozzle 4 employed in the present invention is in the range 2.0–2.4 Kcal/m.Hr.°C., and in case of metallic materials it is in the range 25–30 Kcal/m.Hr.°C. Because of the small thermal conductivity of ceramic materials, even if said air nozzle 4 is subjected to radiant heat of about 1400° C. from the air mixing chamber 21, the heat amount transferred into said air nozzle 4 will be very small compared with metallic materials.

Accordingly, it has been confirmed in experiments that even if the air nozzle 4 was subjected to about 1400° C. ambience it was possible to cool the tip of the nozzle with fuel of minimum 5 l/H and the sensible heat of 5–10% atomizing primary air amount of theoretical combustion air amount, and that there did not occur any carbon adhesion of fuel oil to said tip portion.

In the tunnel kiln of the invention the air nozzle of the burner is made of ceramic material, so that even if the temperature of the secondary combustion air is such high as in the range about 350° C. to 750° C. there can be solved without relying upon water cooling, the trouble of oxidation wear of the tip portion by heating or of blockade of the oil nozzle, and it enabled the burner to be used safely for a longer period of time. Further, not to mention energy saving, the safety ensurance of the tunnel kiln, the simplification of the accessory equipments, the daily maintenance and supervision of the burner have become easier. Thus the present tunnel kiln has excellent functions and effects and a great industrial value.

What is claimed is:

1. An intermittent top firing tunnel kiln comprising kiln walls and a kiln ceiling defining a heating chamber, a burner having a air nozzle assembly mounted to the kiln ceiling, said kiln ceiling being provided with a wind box defining an air mixing chamber and with a burner tile defining a conical opening communicating at one end with said air mixing chamber and at the other end with said heating chamber, a burner support tile, an air nozzle assembly having a ceramic air nozzle mounted to said wind box via said burner support tile and communicating with said air mixing chamber, a metallic air supply pipe connected to said ceramic air nozzle, a metal fixture supporting said air nozzle assembly in said kiln ceiling, an oil nozzle assembly located at the center in said air nozzle assembly for introducing oil into said air mixing chamber, the oil nozzle assembly and the ceramic air nozzle being substantially coterminus and secondary air supply means communicating with said air mixing chamber.

* * * * *